US009580275B2

(12) United States Patent
Moser

(10) Patent No.: US 9,580,275 B2
(45) Date of Patent: Feb. 28, 2017

(54) ELEVATOR SYSTEM HAVING A SAFETY DEVICE

(71) Applicant: Inventio AG, Hergiswil (CH)

(72) Inventor: Christof Moser, Luzern (CH)

(73) Assignee: Inventio AG, Hergiswil (CH)

( * ) Notice: Subject to any disclaimer, the term of this patent is extended or adjusted under 35 U.S.C. 154(b) by 0 days.

(21) Appl. No.: 14/413,741

(22) PCT Filed: Jul. 11, 2013

(86) PCT No.: PCT/EP2013/064665
§ 371 (c)(1),
(2) Date: Jan. 9, 2015

(87) PCT Pub. No.: WO2014/012837
PCT Pub. Date: Jan. 23, 2014

(65) Prior Publication Data

US 2015/0158698 A1 Jun. 11, 2015

(30) Foreign Application Priority Data

Jul. 18, 2012 (EP) ..... 12176936

(51) Int. Cl.

| | |
|---|---|
| ***B66B 5/02*** | (2006.01) |
| ***B66B 15/02*** | (2006.01) |
| ***B66B 5/00*** | (2006.01) |
| ***B66B 1/34*** | (2006.01) |
| *B66B 11/08* | (2006.01) |

(52) U.S. Cl.
CPC ..... *B66B 5/0031* (2013.01); *B66B 1/3492* (2013.01); *B66B 5/0006* (2013.01); *B66B 5/02* (2013.01); *B66B 15/02* (2013.01)

(58) Field of Classification Search
CPC B66B 15/02; B66B 5/02; B66B 5/002; B66B 3/02; B66B 1/26; B66B 1/28; B66B 1/30; G01M 13/04
USPC ..... 187/391, 393, 264, 266, 414; 29/892.1; 254/390; 474/166
See application file for complete search history.

(56) References Cited

U.S. PATENT DOCUMENTS

2004/0178398 A1* 9/2004 Miller ..... F16H 55/44 254/390
2012/0024637 A1* 2/2012 Henneau ..... B66B 5/12 187/394

(Continued)

FOREIGN PATENT DOCUMENTS

CN 201746192 U * 2/2011 ..... B66B 7/00
DE 202009013349 U1 2/2011

(Continued)

OTHER PUBLICATIONS

EPO, Machine Translation, CN 201746192 U, Jun. 20, 2016, pp. 1-5.*

*Primary Examiner* — Michael Mansen
*Assistant Examiner* — Stefan Kruer
(74) *Attorney, Agent, or Firm* — Fraser Clemens Martin & Miller LLC; William J. Clemens

(57) ABSTRACT

An elevator system includes a safety device by which a rotation and/or translation of a fixed bearing part of a rotary bearing of a deflection roller, which is associated with a counterweight, can be detected. An alarm signal is generated by the safety device when the position of the bearing part deviates from a predeterminable value.

15 Claims, 3 Drawing Sheets

(56) References Cited

U.S. PATENT DOCUMENTS

| | | | | |
|---|---|---|---|---|
| 2012/0097487 | A1* | 4/2012 | Winey | B66B 5/022 187/393 |
| 2012/0138391 | A1* | 6/2012 | Weinberger | B66B 5/0031 187/251 |
| 2014/0209414 | A1* | 7/2014 | Paasisalo | B66D 3/04 187/266 |

FOREIGN PATENT DOCUMENTS

| | | | |
|---|---|---|---|
| EP | 0824495 | B1 | 12/1999 |
| EP | 1870368 | A1 | 12/2007 |

* cited by examiner

ELEVATOR SYSTEM HAVING A SAFETY DEVICE

FIELD

The invention relates to an elevator installation as well as to a method for relative positional monitoring of components in an elevator installation.

BACKGROUND

The safety of operation in elevator installations has to be constantly monitored, which embraces, for example, monitoring of the closing state of the doors, monitoring of travel speed and safeguarding against overloading. Such control and monitoring requires detection of values, on the basis of which an actual state is continuously compared with a target state during operation. This is usually carried out by controls and checking devices which allow time-dependent and travel-dependent detection of operating data.

In the case of elevator installations with a counterweight in which a support means is guided in accordance with a block-and-tackle principle (for example 2:1, 4:1 or 6:1 installations), the support cables or support belts on the car side as well as on the counterweight side are, for example, guided over deflecting rollers. On occasion, substantial forces, with which a high level of material loading is connected, act on these deflecting rollers. In particular, bearing damage can arise due to wear. Bearing damage of that kind can as a consequence of increased friction lead to substantial forces or torques on the bearing parts. This can, for example, have the consequence that a stationary axle body is rotated out of its fixing. This undesired rotational movement can lead to consequential damage of the suspension up to the point of total failure of the bearing with possible consequential damage of the elevator installation.

It is known from EP 0 824 495 B1 to monitor the movement states and/or rotational states of components, which are rotatable relative to one another, of a roller bearing. The monitoring is carried out by pulse transmitters or by way of other means for signal detection, which are integrated in the roller bearing. However, roller bearings of that kind are cost-intensive and complicated with regard to system integration. In particular, connection with a control of the elevator installation is required, which can be complicated in the case of roller bearings arranged at moved components.

Moreover, a load lifting device with use of the block-and-tackle principle has become known from DE 20 2009 013349 U1, which comprises a monitoring device for detection of a relative movement between the cable loop and a center roller.

SUMMARY

It is therefore the object of the invention to provide an elevator installation with a safety device which with simple construction and economic format reliably ensures safe operation of the elevator installation. The invention shall in that case ensure monitoring of the operation of a deflecting roller, which is associated with a counterweight, of a support means of the elevator installation.

Fulfillment of the object is defined by the features of an elevator installation with a safety device for relative positional monitoring of components in the elevator installation. The elevator installation in that case comprises an element, which is formed by a counterweight and at which a component stationary relative thereto and formed by a bearing part of a deflecting roller associated with the counterweight is fastened in an intended desired position. The safety device is in that case so constructed and arranged that a positional deviation of the stationary component (i.e. the bearing part) from the desired position with respect to the element (i.e. the counterweight) can be monitored, wherein if a predeterminable positional deviation is exceeded an alarm signal can be generated by the safety device. The elevator installation is distinguished by the fact that the safety device is so constructed and arranged that the positional deviation, which can be monitored by the safety device, comprises a rotation of the stationary component with respect to the counterweight, to which it is attached. In addition, the safety device could also be designed in such a way that a translation of the bearing part or, however, additionally of another component can be monitored.

Denoted by component stationary relative thereto is in the present case a component which in operationally ready state is rigidly mounted with respect to the element to which it is attached. Movability relative to the element is intended neither during operation nor out of operation. It will be obvious that the stationary component can be fastened to be detachable for, for example, maintenance purposes. Rigidly mounted components of that kind can, for example, be fixedly screw-connected, riveted or welded with or to the element or have a press seat. It will be obvious that the element to which the component is attached to be stationary relative thereto can be arranged to be movable in the elevator installation.

Alarm signal here generally designates a signal which can be produced by the safety device and which can be evaluated in different ways by further units of the elevator installation. For example, the alarm signal can be passed onward to a control of the elevator installation, which blocks operation of the elevator installation as a consequence of the alarm signal, for example in an emergency switching off or an emergency stop. Equally, it is conceivable that, for example, an acoustic or a visual alarm is triggered solely or additionally if the positional deviation of the monitored component does not have an immediate safety risk as a consequence. The safety device can in that case comprise an alarm device which further processes the alarm signal. In principle, it is also conceivable for, for example, the alarm signal to be merely registered and, for example, filed in a memory.

A desired position of the component which is stationary in relative terms denotes a position in which it is attached, within the scope of a production or installation tolerance, in operationally ready state to the element (i.e., thus the counterweight). Depending on the respective form of the stationary component, in principle positional deviations from this target position, which do not represent a safety risk and accordingly also do not have to have the consequence of an alarm signal, can arise in the course of operation. By virtue of the predeterminable positional deviation, in which the alarm signal is generated, a range of tolerable positions about the desired position can thus be defined. Only on attainment of the predeterminable positional deviation is an alarm signal generated in accordance with the invention. It will be obvious that for safety reasons the tolerable range able to be predetermined by the predeterminable positional deviations usually has to be selected to be tight for reasons of safety.

Due to the fact that the position of the bearing part, which is stationary in relative terms, with respect to the counterweight, to which the component is attached, can be monitored, an operationally ready arrangement of the bearing part can be ensured. A corresponding safety device can, in particular, be of simple format, since no relative movement has to be taken into consideration in the construction. The parts of the safety device can therefore be subject to only negligible or even no mechanical loading in normal operation. Thus, also only a small or negligible mechanical wear is connected therewith. Equally, as a rule a comparatively low level of precision in the monitoring of a component which is stationary in relative terms is required. If a component of that kind has been detached once, this usually has the consequence of a comparatively significant positional change. The monitoring provided by the safety device of the elevator installation according to the invention is thus basically distinguishable from known forms of positional monitoring in which components moved relative to one another, for example for determining a setting of the car or the speed thereof, can be precisely monitored.

According to the invention a rotational movement, i.e. a rotation of the relatively stationary component with respect to the element which is formed by the counterweight and on which the component formed by the bearing part is mounted, as well as in a given case additionally a translation, i.e. a displacement of the component relative to the element, can be monitored. The safety device is thus capable of versatile use in the elevator installation. In particular, due to the fact that rotation of the stationary component can be monitored, the safety device is also suitable for relatively stationary bearing parts of rotary bearings such as, for example, axle bodies or bearing sleeves. High levels of torque can act on bearing parts of that kind in the event of failure of the bearing and can detach the fixing of the bearing part stationary in relative terms. An additional monitoring of a translation, i.e. displacement of the component relative to the element, also guarantees additional safety in the case of rotary bearings. It will be obvious that monitoring of not only rotation, but also translation or a combination of the two can also be advantageous for every form of component stationary in relative terms. Depending on the respective kind of component, for example in the case of components subject only to static loads, it can also be sufficient to monitor only a translation.

The safety device of the elevator installation according to the invention is suitable for monitoring stationary bearing parts of rotatably mounted parts. As described in the foregoing, according to the invention the stationary component is a bearing part of a rotary bearing, particularly an axial body, of a deflecting roller, which by way of the bearing is mounted on the element to be rotatable with respect thereto. It will be obvious that depending on the respective construction of the rotary bearing it is also possible to monitor other relatively stationary parts of roller bearings or slide bearings such as, for example, bearing sleeves.

Deflecting rollers of that kind can be employed in an elevator installation in a multiplicity of applications. With particular advantage, the stationary component is a bearing part of a deflecting roller for a support means for supporting an elevator car. The support means is in that case connected by way of the deflecting roller with the elevator car and loops around the deflecting roller at least partly. As support means, use can be made of, for example, support cables, support belts or support straps. Deflecting rollers of that kind are used in, for example, 2:1 installations in which the support means is attached by both ends to the ceiling (shaft head) of the elevator shaft, whilst the car and counterweight hang at the support means by way of respective deflecting rollers. Further possible suspensions are, for example, 4:1 and 6:1, these usually being employed in service elevators. The rotatably mounted part, the bearing part of which is to be monitored, can obviously also be, for example, a guide roller or a pivot lever.

Advantageously, the counterweight at which the stationary bearing part is disposed is arranged to be movable in the elevator installation. In particular, the element is preferably movable rectilinearly along an elevator shaft. The element is a counterweight which is displaceable in opposite sense to the elevator car and which is connected with the elevator car by way of the support means. Counterweights of that kind are often difficult to access, as a result of which maintenance is hampered. Particularly in this case, monitoring by the safety device of the components stationary in relative terms is particularly advantageous. However, it will be obvious that the safety device could also be suitable for monitoring stationary components fastened to stationary elements.

Preferably, the positional deviation, which can be monitored by the safety device, from the desired position comprises a deviation component in a direction perpendicular to the movement direction of the movable element. This deviation component can derive from, in particular, a rotation with respect to a geometric axis, which is arranged perpendicularly to the direction of the movement, or, however, also additionally a translation.

Advantageously, the safety device comprises a detection element for detection of the positional deviation of the stationary bearing part of the counterweight deflecting roller from the desired position and a trigger element which is co-operable with the safety device for triggering the alarm signal. Detection element and trigger element are arranged and constructed in such a manner that they can co-operate for triggering the alarm signal at least on attainment of the predetermined positional deviation of the stationary bearing part from the desired position.

Due to the fact that a separate detection element and trigger element are present, the elements can be arranged at different elements of the elevator installation. In particular, the detection element can, for example, be mounted on the stationary bearing part of the counterweight deflecting roller, whilst the trigger element is arranged in stationary location in the elevator installation or at another element of the elevator installation (for example car). The detection element and trigger element are preferably arranged contactlessly with respect to one another when a positional deviation of the stationary bearing part is less than the predeterminable positional deviation. This is of advantage with movable counterweights since in the case of appropriate construction and relative arrangement of detection element and trigger element a movement of the counterweight is not prevented.

Detection element and trigger element thus preferably co-operate only when the predeterminable relative positional deviation of the stationary bearing part is reached. For preference, the co-operation takes place on the basis of a relative positional change of detection element and trigger element.

Advantageously, the trigger element is arranged in stationary position in the elevator installation, particularly in an elevator shaft. In this way the trigger element can co-operate, optionally also be directly connected, in simple manner with elements, which are arranged in stationary position in the elevator installation, of the safety device such as, for example, switching devices or an alarm device. Switching devices of that kind can be actuable by way of the trigger element and in addition, for example, provide a fastening for the trigger element. It will be obvious that depending on the respective requirements a movable arrangement of the trigger element is also possible, wherein in this case a connection with the safety element can usually be achieved only with additional complication.

In principle it is conceivable for the trigger element and detection element to electrically co-operate, i.e., for example in the case of contacting, to electrically close a current circuit of the safety device and in this way trigger the alarm signal. However, the detection element and trigger element preferably mechanically co-operate, when the predeterminable positional deviation of the stationary bearing part from the desired position is reached, in such a manner that a force action on the trigger element can be produced by way of the detection element. As a consequence of the force action it is possible—for triggering the alarm signal—to, for example, actuate a switching device through a thus-achieved positional change of the trigger element. The mechanical-operation can take place on each occasion directly or indirectly.

For preference, a tension force in the trigger element can be produced in the case of the co-operation. This is particularly advantageous in the case of an elongate construction of the trigger element, for example as a wire or pushrod, wherein the tension force preferably can be generated longitudinally of the trigger element. The trigger element may in this instance be able to be torn out of a fastening in the manner of a ripcord due to the force action for actuation of a switching device or separable at a frangible location.

The trigger element is therefore preferably of elongate construction and preferably extends longitudinally of the elevator shaft. A construction of that kind is preferred, particularly in the case of an element movable longitudinally of the elevator shaft and formed by the counterweight, in which case the trigger element can be arranged parallelly to the direction of movement of the counterweight. The trigger element preferably extends substantially over the entire length of the elevator shaft, preferably substantially at least over the range of movement of the counterweight at which the bearing part is arranged to be stationary in relative terms. For preference, the trigger element is in that case of relatively thin construction, for example a thin rod or wire, whereby it can be accommodated in space-saving manner.

A switching device of the safety device is preferably arranged in an end region of the trigger element, which switching device is actuable by way of the trigger element. An arrangement of the switching device in an end region of the trigger element has the advantage that the switching device can, in the case of an end fastening of the trigger element, be arranged to be stationary. The trigger element can then be connected in the end region directly with the switching device, for example fastened thereto. The actuation of the switching device can then, as mentioned, be effected in the manner of, for example, a ripcord or, in the case of a rod-like construction, in the manner of a push rod.

However, the switching device can also be arranged at the trigger element separately therefrom. In this case, the switching device can be actuable by way of, for example, an entrainer of the trigger element. In these circumstances the actuation takes place, for example, after release of the trigger element by, for example, mechanical separation as a consequence of longitudinal displacement of the trigger element.

It will be obvious that the switching device can in variants also be arranged in any desired area of the trigger element. For example, a lateral deflection of the trigger element can be used for actuation of the switching device, in which case the switching device can preferably be arranged in the region of the greatest deflection.

Advantageously, the trigger element comprises a wire or a cable. The wire or cable can be installed in a simple way, for example in stationary position in the elevator shaft. In particular, a wire or cable can be constructed basically to be as long as desired, which is advantageous particularly for a trigger element which extends over the entire length of an elevator shaft.

The wire (also standing for cable in the following) can be constructed to be electrically conductive, for example as a metal wire (or wire cable). In this case, for example, when contact between detection element and wire takes place for triggering the alarm signal a current circuit of the safety device can be closed. The current circuit can in that case be closed by way of, for example, a longitudinal guidance of the counterweight with respect to the safety device. Equally, there can in the alternative be a current flow in the wire which for triggering of the alarm signal can be interrupted when there is mechanical separation of the wire by the trigger element.

For preference, a trigger element constructed as a wire is employed even in a case of mechanical triggering of the alarm signal. In this case, electrical conductivity is not required, for which reason use can in principle also be made of, for example, a synthetic material wire or synthetic material cable. The construction of the trigger element as a wire then has the advantage that a mechanical co-operation of detection element and trigger element also enables deformation of the trigger element. For example, the wire can be wound up by the detection element as a consequence of the positional deviation of the component stationary in relative terms, whereby for triggering the alarm signal a tension force can be generated in the wire. In variants, the wire can, for example, also be directly cut through by the detection element.

The wire or cable is preferably suspended at one end at a fastening in the elevator shaft and tensioned by a weight. The fastening can be arranged at, for example, a ceiling of the elevator shaft in the shaft head, wherein the wire or the cable hangs under tension by the weight in the elevator shaft. In forms of embodiment equally preferred depending on respective requirements, the wire or the cable can be tensioned between two fastenings in the elevator shaft. The fastenings can in that case be arranged at the ceiling and floor of the elevator shaft or also at a shaft wall. Tension in the wire is in this case achievable by way of, for example, a spring device. The fastenings can be provided by, for example, switching devices of the safety device, i.e. the wire can be directly fastened to the switching devices.

In a preferred form of embodiment a frangible location is present in the region of the fastening or at least one of the fastenings of the wire or cable. At the frangible location the wire or cable is, as a consequence of the force action produced by the detection element, at least partly releasable in dependence on the respective arrangement of the frangible location. This embodiment is advantageous particularly in the case of a wire which is suspended in the elevator shaft and tensioned by a weight. If the additional force action by the detection element acts on the wire the frangible location is separable and the wire can be released. Due to the weight, the wire drops, whereby the switching device can be triggered by way of, for example, the wire itself or the weight. The frangible location can be formed at the fastening of the wire or at the wire itself. Instead of the weight, the wire can also be tensioned by a spring arrangement, which, for example, additionally triggers the switching device in the case of release of the wire. A frangible location for release of the wire can, however, also be advantageous in embodiments in which the wire is tensioned between two fastenings.

Advantageously the detection element of the safety device is mechanically directly, in particular rigidly, connected with the bearing part stationary in relative terms. In this way, a positional deviation of the stationary bearing part has the consequence of a direct positional change of the detection element, whereby this can co-operate with the correspondingly arranged trigger element. It will be obvious that the detection element can also be indirectly connected, for example by way of a transmission, with this stationary component. However, in constructional and mechanical terms this is usually more complicated and thus possibly more susceptible to faulty functioning.

The detection element preferably comprises at least one entrainer for the trigger element, which in the case of a positional deviation from the desired position of the stationary bearing part is movable towards the trigger element. The entrainer can be constructed as, for example, a rod or, for better entraining of the trigger element, also have, for example, a hook-shaped structure. In the desired position of the component stationary in relative terms, as well as in the case of a positional deviation which is smaller than the predeterminable positional deviation, the entrainer is preferably arranged contactlessly with respect to a trigger element. On attainment of the predeterminable positional deviation the entrainer can entrain the trigger element and, for example in the case of a wire, wind up or mechanically separate this.

Since the stationary component is a bearing part of a rotary bearing the entrainer of the detection element is preferably directly fastened to the bearing part in the direction of the axis of rotation and at a spacing therefrom. With the thus-achieved eccentric arrangement the entrainer can be brought up to the trigger element as a consequence of rotation of the component.

In a preferred form of embodiment the entrainer comprises lateral limiters, which are, in particular, elongate and between which the trigger element is arranged, preferably contactlessly, when the stationary bearing component is in the desired position. The arrangement is preferably also contactless when a positional deviation of the bearing part stationary in relative terms is less than the predetermined positional deviation.

The limiters are preferably arranged to be rigid relative to one another and at a spacing from one another and thus form an intermediate space for the trigger element. In the event of rotation about an axis parallel to the limiters these can pick up the trigger element and, for example in the case of a wire, wind it up. Due to the fact that two limiters are present the co-operation of trigger element and detection element can take place symmetrically regardless of the rotational sense.

An intermediate space between the lateral limiters is preferably closed off so that the trigger element is completely surrounded. In this case, the entrainer can be constructed as, for example, an eye or opening in the entrainer. The trigger element is preferably led through the opening so that in a case of rotation of the opening about an axis perpendicular to the plane of the opening the rim comes into contact with the trigger element and in a given case can entrain this. It will be obvious that constructions different from completely surrounded openings are also conceivable. For example, an end plate can be mounted by way of two bearing supports, which act as lateral limiters, at an end face of the stationary component and at a spacing therefrom. In this case the trigger element can be led through the thus fully bounded intermediate space between end plate and end face of the component. The entrainer can also comprise a wire loop which edges the opening. In variants, the opening can also be formed directly in the stationary component, for example as a transverse bore in an axial body.

The invention also relates to a method for relative positional monitoring of components in an elevator installation with a safety device, particularly in an elevator installation according to the invention. The elevator installation comprises an element, which is formed by a movable counterweight and at which is fastened a component which is stationary relative to this element in an intended desired position, wherein the mentioned component is a bearing part of a bearing of a deflecting roller mounted on the counterweight. The method comprises monitoring of a positional deviation of this stationary component from the desired position with respect to the counterweight by the safety device as well as triggering of an alarm by an alarm device of the safety device when a predetermined relative positional deviation of the stationary bearing part with respect to the element is exceeded.

The triggering of the alarm preferably takes place by mechanical co-operation of a detection element, which is connected with the component stationary in relative terms, of the safety device with a trigger element, which is, in particular, arranged in stationary position in the elevator installation, of the safety device. In that case, the mechanical co-operation is preferably of such a kind that a force action on the trigger element is produced, on the basis of which a switching device of the alarm device is actuated. Alternatively, the method can also comprise actuation of the switching device by closing or interruption of a current circuit conducted by the trigger element. Further method steps are evident from the present description of the elevator installation.

Further advantageous forms of embodiment and feature combinations of the invention are evident from the following detail description.

DESCRIPTION OF THE DRAWINGS

The drawings used for explanation of the embodiments schematically show.

Basically, the same parts are provided with the same reference numerals in the figures.

DETAILED DESCRIPTION

Figure 1:
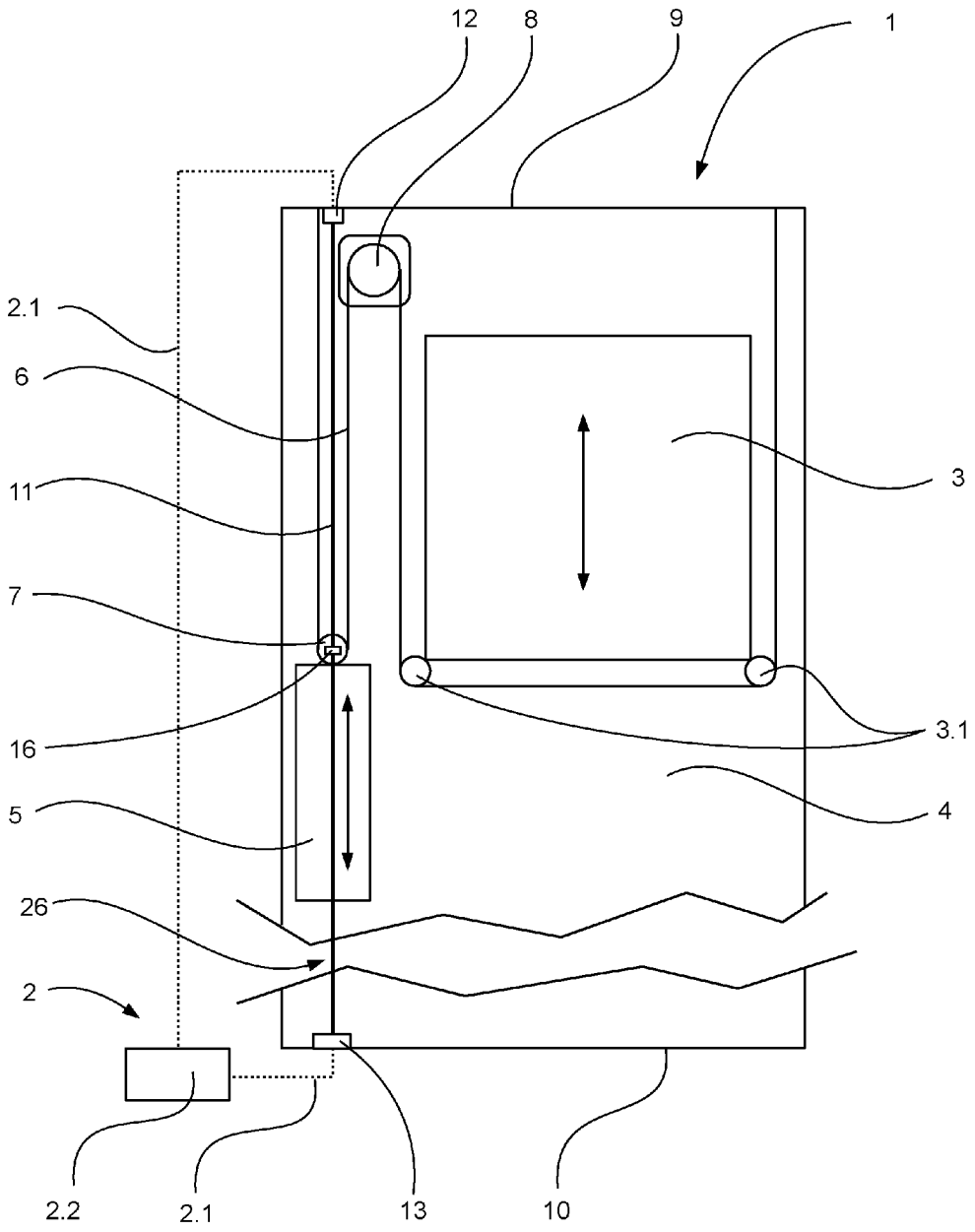
FIG. 1 is a schematic elevation view of an elevator installation according to the invention with safety device.

FIG. 1 shows a schematic view of an elevator installation 1 according to the invention with a safety device 2. The elevator installation comprises an elevator car 3, which is movable in vertical direction in an elevator shaft 4. A counterweight 5, which is similarly displaceable in vertical direction in a longitudinal guide 18 (see FIG. 2), is arranged at a wall of the elevator shaft 4. Above the counterweight 5 a support means 6 is fixedly anchored to the ceiling 9 of the elevator shaft 4. The support means 6 runs from the anchorage in vertical direction downwardly to a deflecting roller 7 of the counterweight 5 and is guided halfway around this. From the deflecting roller 7 the support means 6 runs in vertical direction upwardly to a further deflecting roller 8, which is arranged in stationary position in an upper region at the ceiling 9 of the elevator shaft 4. From the deflecting roller 8 the support means 6 runs downwardly in vertical direction near the elevator car 3 and is guided below the elevator car 3 by way of deflecting rollers 3.1 from one side of the elevator car 3 to the opposite side. From there the support means 6 is guided in vertical direction upwardly near the elevator car 3 to a further anchorage at the ceiling 9 of the elevator shaft 4. With this arrangement (2:1 installation) there is produced a simple block-and-tackle by which, in comparison with a 1:1 installation with direct connection of car and counterweight via a stationary deflecting roller, twice the useful load at half the speed can be lifted.

A trigger element 26, which is constructed as a wire cable 11, of the safety device 2 is stretched parallel to a displacement path of the counterweight 5 between the ceiling 9 and the floor 10 of the elevator shaft 4. The wire cable 11 is fastened not only at the ceiling 9, but also at the floor 10 to a respective switching device 12 or 13 of the safety device 2. The wire cable 11 can obviously also be fastened to a shaft wall, in which case the switching devices 12 and 13 can optionally also be arranged at the shaft wall (not illustrated). The attachments of the wire cable 11 to the switching devices 12 and 13 can then comprise spring devices which keep the wire cable 11 under tension. The switching devices 12 and 13 are constructed in such a manner that in the case of a sufficient tension force longitudinally of the wire cable 11 a switching process can be triggered. The switching devices 12 and 13 are connected by way of signal lines 2.1 with a control unit 2.2 of the safety device 2. The control unit 2.2 generates an alarm signal in the event of a switching process in one or both of the switching devices 12 and 13. The alarm signal can, for example, be passed to a control unit (not illustrated) of the elevator installation 1. It will be obvious that the control unit 2.2 of the safety device 2 can be integrated in the control unit of the elevator installation 1.

The wire cable 11 runs in front of an end face of an axial body 15 (see FIG. 2*b*) of a bearing of the deflecting roller 7. The axial body 15 is fastened to the counterweight 5 to be stationary relative thereto. The axial body 15 is disposed in a desired position, i.e. a position in which it is mounted in intended stationary position for the operation. The deflecting roller 7 is, for example, arranged by way of a roller bearing or a slide bearing on the stationary axial body 15 to be rotatable about a geometric axis A of rotation. The geometric axis A of rotation in that case substantially corresponds with a longitudinal axis of the axial body 15.

Figures 2A, 2B:
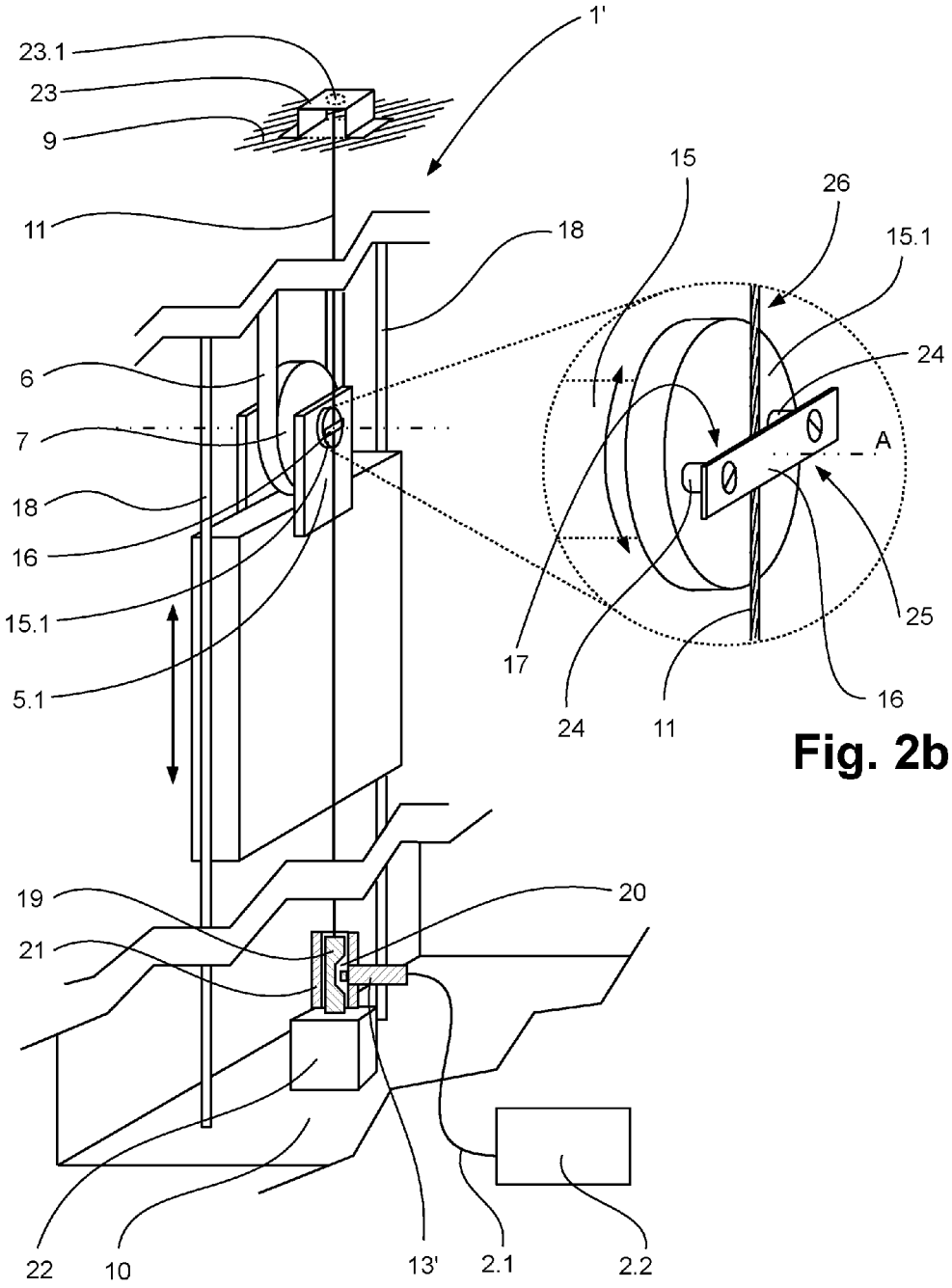
FIG. 2*a* is a perspective view of a counterweight with deflecting roller of an elevator installation according to the invention.
FIG. 2*b* is a detail enlargement of an end of an axial body of the deflecting roller of the counterweight of FIG. 2*a;*

The wire cable 11 substantially intersects the axis A of rotation of the deflecting roller 7 (see FIG. 2*b*). Due to the fact that the wire cable 11 is arranged parallel to the displacement path of the counterweight 5 it intersects the axis A of rotation regardless of the displacement position of the counterweight 5. Equally, the spacing of the wire cable 11 from the axial body 15 in axial direction of A, i.e. also in a direction perpendicular to the wire cable 11, also remains constant regardless of the displacement position of the counterweight 5. The wire cable 11 can therefore pass contactlessly through an opening 17 (see FIG. 2*b*), which is formed to be stationary relative to the counterweight 5 and is bounded in direction perpendicular to the wire cable 11, in any displacement position of the counterweight 5.

The opening 17 is bounded in axial direction of A by an end face 15.1 of the axial body 15 and an end plate 16 mounted at a spacing therefrom. It will be obvious that the end face 15.1 of the axial body 15 can be provided by a separate element, which is screw-connected at the end with the axial body 15, or by the axial body 15 itself. The end plate 16 is constructed as a strip, which is arranged to be horizontal in the desired position of the axial body 15, and is held by bearing supports 24 at a spacing from the end face 15.1 (see FIG. 2*b*). The bearing supports 24 are arranged at a spacing from one another on either side of the wire cable 11 and form parts of a detection element 25 of the safety device 2. End face 15.1, end plate 16 and bearing supports 24 bound the opening 17, the plane of opening of which is arranged substantially perpendicularly to the wire cable 11. The wire cable 11 passes contactlessly through the opening 17 when the axial body 15 is in the desired position (see FIG. 2*b*).

FIG. 2*a* shows, schematically, a perspective view of the counterweight 5 of a slightly modified elevator installation 1' according to the invention. The counterweight 5 is displaceably guided at guide shoes (not illustrated) at both sides in vertical guide rails of the longitudinal guide 18.

The counterweight 5 comprises a mounting structure 5.1 in the form of mounting plates on which the axial body 15 is mounted to be stationary relative to the counterweight 5. The end face 15.1 of the axial body 15 protrudes in axial direction, i.e. in the direction of A, beyond the mounting structure 5.1 and projects above the counterweight 5. The wire cable 11 arranged in front of the end face 15.1 thus runs entirely outside a region which is covered by the counterweight 5 during displacement.

In the elevator installation 1' of FIG. 2*a* the wire cable 11 is, by contrast to the elevator installation 1, suspended at a fastening 23 at the ceiling 9 of the elevator shaft 4. The fastening 23 comprises a frangible location 23.1 at which the wire cable 11 is fastened. A weight 22, hanging freely from the wire cable 11, is held in the region of the floor 10 of the elevator shaft 4. The wire cable 11, hanging from the fastening 23 in vertical direction, is tensioned by the weight 22.

The wire cable 11 is fastened to the weight 22 by way of an entrainer 19. The entrainer 19 is arranged at the weight 22 directly thereabove and has a lateral recess 20 with control surfaces formed symmetrically in the direction of the wire cable 11. The entrainer 19 is guided in a longitudinal guide 21 so that the entrainer 19 cannot deviate in this region laterally, i.e. perpendicularly to the longitudinal direction of the wire cable 11. A switching device 13', which protrudes by an actuation element into the recess 20, is arranged at the longitudinal guide 21. If a sufficiently large displacement of the entrainer 19 in the direction of the wire cable 11 relative to the longitudinal guide 21 takes place, i.e. relative to the switching device 13', the actuating element slides on the cam surfaces of the recess 19. In that case the entrainer 19 actuates the switching device 13', whereby a switching process is triggered. The switching device 13' is connected by way of the signal line 2.1 with the control unit 2.2 of the safety device 2, which as a consequence of the switching process can generate an alarm signal.

FIG. 2*b* shows a detail enlargement of a perspective view onto the end face 15.1 of the axial body 15. The end plate 16, which in the direction of A is arranged in front of the end face 15.1, with bearing supports 24 can be seen. Between the bearing supports 24 as well as the end face 15.1 and end plate 16 the wire cable 11 passes through the opening.

Figure 3A:
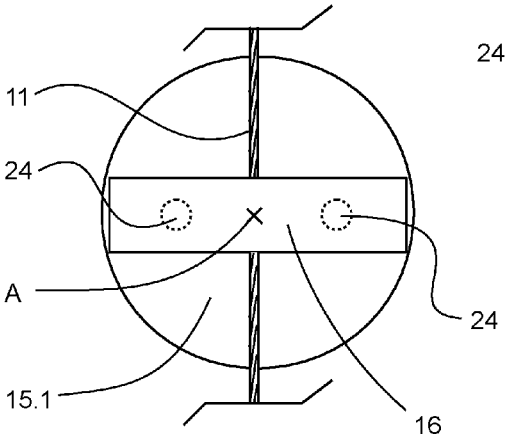
FIG. 3*a* is a view according to FIG. 2*b* in plan along an axis A of rotation with an axial body in the desired position.

FIG. 3*a* shows a plan view of the end face 15.1 of the axial body 15 according to FIG. 2*b* along the axis A of rotation in the desired position. The two bearing supports 24 are arranged on either side of the wire cable 11 with respect to A and form lateral limiters of the detection element 25. The end plate 16 similarly forms a limiter in the axial direction of A.

Figure 3B:
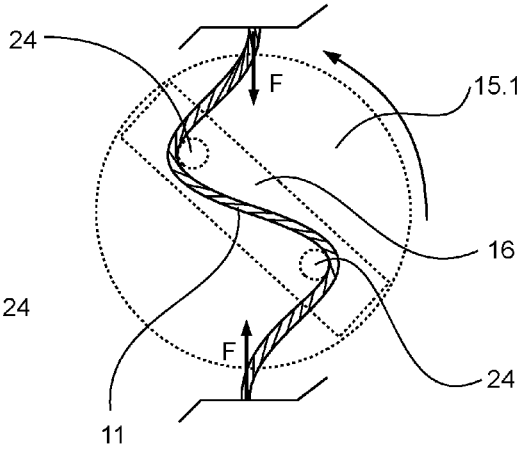
FIG. 3*b* is a view according to FIG. 3*a* with the axial body in a position deviating from the desired position.

FIG. 3*b* shows a view according to FIG. 3*a*, wherein the axial body is rotated about A into a position which departs from the desired position. In that case, a predeterminable position deviation is exceeded, so that the detection element 25 mechanically co-operates with the trigger element 26. This can happen if, for example, a roller bearing of the deflecting roller 7 seizes, for example due to deficient maintenance, on the axial body 15 and the axial body 15 is rotated out of its fastening. In that event the bearing supports 24 come into contact with the wire cable 11 and entrain this. The wire cable 11 is wound on the bearing supports 24, in which case a tension force F longitudinally of the wire cable 11 is generated.

In the case of the elevator installation 1, this has the consequence that the tension force triggers a switching process in the switching devices 12 and/or 13. A corresponding switching signal is transmitted by way of the signal lines 2.1 to the control unit 2.2, which generates the alarm signal. The switching devices 12 and 13 can optionally be constructed in such a manner that the wire cable 11 for triggering the switching process is ripped out in the manner of a ripcord.

In the case of the elevator installation 1' the tension force F has the consequence that the frangible location 23.1 breaks and the wire cable 11 is thus released. As a consequence of the release, the wire cable 11 and the weight 22 drop in the direction of the floor 10 and move the entrainer 19 connected therewith downwardly. The cam surfaces of the recess 20 actuate the switching device 13' and trigger a switching process. A switching signal is transmitted by way of the signal line 2.1 to the control unit 2.2, which generates the alarm signal. Alternatively, insofar as, for example, the frangible location 23.1 should fail, in a given case with sufficient tension force F the weight 22 can be drawn upwardly against gravitational force, whereby the entrainer 19 is moved upwardly. If the recess 20 is formed at both sides a switching process in the switching device 13' can similarly be triggered in this way.

It is apparent from FIGS. 3*a* and 3*b* that the arrangement of the bearing supports 24, which act as lateral limiters, predetermine a positional deviation at which the bearing supports 24 come into contact with the wire cable 11. In the case of a smaller spacing than in FIG. 2*a* and, for example, an arrangement displaced in parallel upwardly or downwardly the wire cable 11 would be picked up by the bearing supports 24 already at a smaller positional deviation.

It is directly evident that the elevator installations 1 and 1', which are shown in the figures, are also suitable for forms of embodiment in which a switching process is electrically triggered. For example, instead of the switching devices 12 and 13 of the elevator installation 1 contacts of a current circuit of the safety device 2 for fastening of the wire cable 11 can be provided. The wire cable 11 tensioned between these contacts closes the current circuit. In the case of an interruption, for example, as a consequence of a mechanical separation of the wire cable 11, the safety device can generate the alarm signal. For that purpose, a frangible location can be provided at, for example, the wire cable 11 itself or at the contacts.

Equally, it is evident that the bearing supports 24 in the case of appropriate construction as electrical contacts are suitable for contacting the wire cable 11. If, for example, a voltage potential is present by way of the control unit 2.2 at the wire cable 11 as well as at the bearing supports 24 (for example led by way of the guide rails 18 and the counterweight 5 to the bearing supports 24) a current can flow in the case of an electrically conductive contact between bearing supports 24 and wire cable 11. Due to the current flow an alarm signal can be generated by the safety device 2. In this case a force action on the wire cable 11 is not required. Further forms of embodiment will be immediately evident to the expert.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. An elevator installation including an elevator car, a counterweight, a support device supporting the elevator and the counterweight, wherein the counterweight is connected with the support device by at least one deflecting roller mounted to be rotatable about a rotary bearing and wherein the support device at least partly loops around the deflecting roller, wherein the rotary bearing has a bearing part stationary relative to the counterweight, wherein the bearing part is fixed to the counterweight in a desired position, and a safety device for positional monitoring of the bearing part in the elevator installation, wherein further:

the bearing part being an axial body;

the safety device being arranged for monitoring a positional deviation of the bearing part from the desired position with respect to the counterweight, wherein the positional deviation is a rotation of the bearing part about an axis of rotation of the bearing part; and the safety device generating an alarm signal if the monitored positional deviation exceeds a predeterminable positional deviation, wherein the safety device includes a detection element for detecting the positional deviation of the bearing part from the desired position and a trigger element for triggering the alarm signal, wherein the detection element and the trigger element are configured and arranged for triggering the alarm signal at least on attainment of the predeterminable positional deviation of the bearing part from the desired position, and wherein the trigger element is arranged in a stationary position in an elevator shaft of the elevator installation.

2. The elevator installation according to claim 1, wherein the detection element and the trigger element are mechanically co-operable on attainment of the predeterminable positional deviation of the bearing part from the desired position, wherein a force action on the trigger element is generated by mechanical co-operation between the detection element and the trigger element.

3. The elevator installation according to claim 2, wherein the force action is a tension force on the trigger element.

4. The elevator installation according to claim 1, wherein the positional deviation monitored by the safety device includes a deviation component in a direction perpendicular to a direction of movement of the counterweight.

5. The elevator installation according to claim 1, including a switching device actuable by the trigger element and arranged in an end region of the trigger element.

6. An elevator installation including an elevator car a counterweight, a support device supporting the elevator and the counterweight, wherein the counterweight is connected with the support device by at least one deflecting roller mounted to be rotatable about a rotary bearing and wherein the support device at least partly loops around the deflecting roller, wherein the rotary bearing has a bearing part stationary relative to the counterweight, wherein the bearing part is fixed to the counterweight in a desired position, and a safety device for positional monitoring of the bearing part in the elevator installation, wherein further:

the bearing part being an axial body;

the safety device being arranged for monitoring a positional deviation of the bearing part from the desired position with respect to the counterweight, wherein the positional deviation is a rotation of the bearing part about an axis of rotation of the bearing part; and the safety device generating an alarm signal if the monitored positional deviation exceeds a predeterminable positional deviation, wherein the safety device includes a detection element for detecting the positional deviation of the bearing part from the desired position and a trigger element for triggering the alarm signal, wherein the detection element and the trigger element are configured and arranged for triggering the alarm signal at least on attainment of the predeterminable positional deviation of the bearing part from the desired position, and wherein the trigger element is of elongate construction and extends longitudinally in an elevator shaft of the elevator installation and parallel to a direction of movement of the counterweight in the elevator shaft.

7. The elevator installation according to claim 6, wherein the trigger element extends substantially at least over a length of a range of movement of the counterweight in the elevator shaft.

8. An elevator installation including an elevator car, a counterweight, a support device supporting the elevator and the counterweight, wherein the counterweight is connected with the support device by at least one deflecting roller mounted to be rotatable about a rotary bearing and wherein the support device at least partly loops around the deflecting roller, wherein the rotary bearing has a bearing part stationary relative to the counterweight, wherein the bearing part is fixed to the counterweight in a desired position, and a safety device for positional monitoring of the bearing part in the elevator installation, wherein further:

the bearing part being an axial body;

the safety device being arranged for monitoring a positional deviation of the bearing part from the desired position with respect to the counterweight, wherein the positional deviation is a rotation of the bearing part about an axis of rotation of the bearing part; and the safety device generating an alarm signal if the monitored positional deviation exceeds a predeterminable positional deviation, wherein the safety device includes a detection element for detecting the positional deviation of the bearing part from the desired position and a trigger element for triggering the alarm signal, wherein the detection element and the trigger element are configured and arranged for triggering the alarm signal at least on attainment of the predeterminable positional deviation of the bearing part from the desired position, and wherein the trigger element is a wire or a cable.

9. The elevator installation according to claim 8, wherein the trigger element is suspended at one end at an attachment in an elevator shaft of the elevator installation and is tensioned by a weight or is stretched between the attachment and another attachment in the elevator shaft.

10. The elevator installation according to claim 9, including a frangible location present in a region of at least one of the attachment and the another attachment.

11. An elevator installation including an elevator car, a counterweight, a support device supporting the elevator and the counterweight, wherein the counterweight is connected with the support device by at least one deflecting roller mounted to be rotatable about a rotary bearing and wherein the support device at least partly loops around the deflecting roller, wherein the rotary bearing has a bearing part stationary relative to the counterweight, wherein the bearing part is fixed to the counterweight in a desired position, and a safety device for positional monitoring of the bearing part in the elevator installation, wherein further:

the bearing part being an axial body;

the safety device being arranged for monitoring a positional deviation of the bearing part from the desired position with respect to the counterweight, wherein the positional deviation is a rotation of the bearing part about an axis of rotation of the bearing part; and the safety device generating an alarm signal if the monitored positional deviation exceeds a predeterminable positional deviation, wherein the safety device includes a detection element for detecting the positional deviation of the bearing part from the desired position and a trigger element for triggering the alarm signal, wherein the detection element and the trigger element are configured and arranged for triggering the alarm signal at least on attainment of the predeterminable positional deviation of the bearing part from the desired position, and wherein the detection element is mechanically directly and rigidly connected with the bearing part.

12. An elevator installation including an elevator car, a counterweight, a support device supporting the elevator and the counterweight, wherein the counterweight is connected with the support device by at least one deflecting roller mounted to be rotatable about a rotary bearing and wherein the support device at least partly loops around the deflecting roller, wherein the rotary bearing has a bearing part stationary relative to the counterweight, wherein the bearing part is fixed to the counterweight in a desired position, and a safety device for positional monitoring of the bearing part in the elevator installation, wherein further:

the bearing part being an axial body;

the safety device being arranged for monitoring a positional deviation of the bearing part from the desired position with respect to the counterweight, wherein the positional deviation is a rotation of the bearing part about an axis of rotation of the bearing part; and the safety device generating an alarm signal if the monitored positional deviation exceeds a predeterminable positional deviation, wherein the safety device includes a detection element for detecting the positional deviation of the bearing part from the desired position and a trigger element for triggering the alarm signal, wherein the detection element and the trigger element are configured and arranged for triggering the alarm signal at least on attainment of the predeterminable positional deviation of the bearing part from the desired position, and wherein the detection element includes an entrainer that is movable towards the trigger element in response to the positional deviation from the desired position.

13. The elevator installation according to claim 12, wherein the entrainer has lateral, elongate limiters between which the trigger element is arranged contactlessly when the bearing part is in the desired position.

14. A method for positional monitoring of components in an elevator installation with a safety device, wherein the elevator installation includes a counterweight, which is displaceable in an opposite sense to an elevator car and to which a bearing part, which is stationary with respect to the counterweight in a desired position, of a rotary bearing of a deflecting roller mounted on the counterweight is attached, comprising the steps of:

monitoring a rotational positional deviation of the bearing part from the desired position about an axis of rotation of the bearing part by the safety device; and generating an alarm signal from the safety device if a predeterminable positional deviation of the bearing part is exceeded, wherein the generation of the alarm signal is effected by mechanical co-operation of a detection element, which is connected with the bearing part, with a trigger element, which is arranged in the elevator installation in a stationary location, wherein the mechanical co-operation produces a force action on the trigger element.

15. The method according to claim 14, wherein the force action is a tension force on the trigger element.

* * * * *